United States Patent [19]

Knell et al.

[11] 4,071,432

[45] Jan. 31, 1978

[54] STAGED HEATING BY OXIDATION OF CARBONACEOUS MATERIAL

[75] Inventors: Everett W. Knell, Los Alamitos; Norman W. Green, Upland, both of Calif.

[73] Assignee: Occidental Petroleum Corporation, Los Angeles, Calif.

[21] Appl. No.: 700,042

[22] Filed: June 25, 1976

[51] Int. Cl.[2] ..... C10G 1/02

[52] U.S. Cl. ..... 208/8; 208/11 R; 201/12

[58] Field of Search ..... 208/11 R, 8; 201/10, 201/12

[56] References Cited

U.S. PATENT DOCUMENTS

| | | | |
|---|---|---|---|
| 2,741,549 | 4/1956 | Russell | 208/8 |
| 2,982,701 | 5/1961 | Scott | 208/11 R |
| 3,574,065 | 4/1971 | Eddinger et al. | 201/12 |
| 3,839,186 | 10/1974 | Berger | 208/8 |
| 3,847,566 | 11/1974 | Wilson | 48/202 |
| 3,876,392 | 4/1975 | Kalina et al. | 48/210 |
| 3,890,111 | 6/1975 | Knudsen | 48/197 |
| 3,891,402 | 6/1975 | Nahas et al. | 48/197 |
| 3,927,996 | 12/1975 | Knudsen et al. | 48/197 |
| 3,957,459 | 5/1976 | Mitchell et al. | 48/197 |
| 3,958,957 | 5/1976 | Koh et al. | 48/197 |
| 3,972,801 | 8/1976 | Gregoli | 208/11 R |
| 3,975,168 | 8/1976 | Gorbaty | 48/197 |
| 3,985,519 | 9/1976 | Kalina | 48/202 |
| 3,998,607 | 12/1976 | Wesselhoft et al. | 48/197 |

*Primary Examiner*—Herbert Levine
*Assistant Examiner*—James W. Hellwege
*Attorney, Agent, or Firm*—Christie, Parker & Hale

[57] ABSTRACT

A carbonaceous material is pyrolyzed in the presence of a particulate source of heat obtained by the partial oxidation of a carbon containing solid residue of the carbonaceous material. The heat obtained from the oxidation of the carbon containing solid residue is maximized by preheating the carbon containing solid residue with a hot gas stream obtained by oxidizing the gaseous combustion products of the carbon containing solid residue.

26 Claims, 2 Drawing Figures

STAGED HEATING BY OXIDATION OF CARBONACEOUS MATERIAL

BACKGROUND OF THE INVENTION

Due to increasing scarcity of fluid fossil fuels such as oil and natural gas, much attention is being directed towards converting carbonaceous material such as coal, oil shale, and solid waste to liquid and gaseous hydrocarbons by pyrolyzing the carbonaceous material. Pyrolysis can occur under nonoxidizing conditions in the presence of a particulate source of heat.

The particulate source of heat may be obtained by at least partially oxidizing a carbon containing solid residue resulting from the pyrolysis of the carbonaceous material. In order to maximize recovery of the heating value during the oxidation of the carbon containing solid residue, it is desirable to maximize the production of carbon dioxide and minimize the production of carbon monoxide. However, the kinetics and thermodynamic equilibrium of the oxidation of carbon favor increased production of carbon monoxide relative to carbon dioxide at temperatures greater than about 1200° F and as the reaction time increases. Since pyrolysis of carbonaceous materials often is conducted at temperatures greater than 1200° F and can approach temperatures as high as 2000° F or higher, it is necessary to form a particulate source of heat having temperatures greater than 1200° F. Thus production of carbon monoxide inevitably occurs in the oxidation step because of the high temperatures used and long residence times encountered in high capacity systems. The carbon monoxide formed represents a loss of thermal efficiency of the process.

Therefore, there is a need for a process for preparing a particulate source of heat for the pyrolysis of a carbonaceous material by the oxidization of a carbon containing solid residue of the carbonaceous material which maximizes production of carbon dioxide and minimizes production of carbon monoxide.

SUMMARY OF THE INVENTION

According to the present invention, there is provided a process with the above features.

In the process of this invention, carbonaceous material is contacted with a particulate source of heat in a pyrolysis reaction zone maintained at a temperature greater than about 600° F to yield as products of pyrolysis pyrolytic vapors and a carbon containing solid residue. The carbon containing solid residue is separated from the pyrolytic vapors and then preheated in a heating zone with hot gases, preferably by direct contact with the hot gases to allow complete heat transfer from the hot gas to the carbon containing residue. The preheated carbon containing solid residue is then separated from at least the bulk of the hot gases.

Next, a portion of the preheated carbon containing solid residue is at least partially oxidized in a combustion zone in the presence of an oxygen containing gas, thereby yielding gaseous combustion products of the carbon containing solid residue including carbon monoxide and forming the particulate source of heat. The particulate source of heat is then separated from the gaseous combustion products of the carbon containing solid residue and passed to the pyrolysis reaction zone to provide at least a portion of the heat required for pyrolysis of the carbonaceous material. The gaseous combustion products of the carbon containing solid residue are combined in the heating zone with a sufficient amount of oxygen to completely oxidize the carbon monoxide in the gaseous combustion products to form the hot gases for preheating the carbon containing solid residue in the heating zone. At least a stoichiometric amount of oxygen in an oxygen containing gas is used to oxidize the gaseous combustion products of the carbon containing solid residue so that all the carbon monoxide in this stream is oxidized to carbon dioxide. Any excess oxygen reacts with carbon containing solid residue in the heating zone to form particulate souce of heat.

Preferably the carbon containing solid residue and the gaseous combustion products are combined, and then this combined stream is combined with the oxygen in the heating zone. This sequence of combining the three streams minimizes exposure of the carbon containing solid residue to high temperatures and thereby helps prevent carbon monoxide formation in the heating zone.

The heating zone preferably is maintained at a temperature less than 1800° F and less than the temperature in the combustion zone to minimize carbon monoxide formation where excess oxygen is used to oxidize the gaseous combustion products of the carbon containing solid residue. The combustion zone is maintained at a temperature consonant with the temperature desired in the pyrolysis reaction zone, and depending upon the weight ratio of the particulate source of heat to carbonaceous material in the pyrolysis reaction zone, from about 100 to 500° F higher than the temperature in the pyrolysis reaction zone.

It is preferred that when separating preheated carbon containing solid residue from the hot gas present in the heating zone, a portion of the hot gas stream be withdrawn with the preheated carbon containing solid residue.

Preferably, the step of preheating the carbon containing solid residue and the step of separating the preheated carbon containing solid residue from the hot gas stream occur simultaneously in a cyclone heating-separation zone to minimize production of carbon monoxide and to reduce operating and capital costs.

Preferably, the step of partially oxidizing preheated carbon containing solid residue and the step of separating particulate source of heat from gaseous combustion products occur simultaneously in a cyclone combustion-separation zone. This reduces capital and operating costs of the process. In order to minimize production of carbon monoxide in the cyclone combustion-separation zone, it is preferred that the residence time of solids in the separation zone be less than about 5 seconds, and more preferably, less than about 3 seconds.

The process of this invention is an effective and efficient method for preparing a particulate source of heat for pyrolysis of a carbonaceous material because the gaseous combustion products of the carbon containing solid residue of the carbonaceous material are substantially completely oxidized for form an oxidized, hot gas stream for preheating the carbon containing solid residue. Thus, almost all of the potential heating value of the carbon atoms oxidized is utilized by this process. Also, high temperatures can be maintained in the pyrolysis reaction zone without fear that this will result in thermal inefficiency due to increased carbon monoxide production during the oxidation of the carbon containing solid residue. Furthermore, the amount of fines lost from the system can be minimized by operating the cyclone separation for the preheated carbon containing solid residue such that a portion of the hot gas is withdrawn along with the preheated carbon containing solid residue. This minimizes loss of the valuable carbon containing solid residue from the process.

These and other features, aspects and advantages of the present invention will become more apparent with reference to the following drawings, detailed description of the invention and appended claims.

DRAWINGS

DETAILED DESCRIPTION OF THE INVENTION

According to the present invention, there is provided a process for oxidizing a carbon containing solid residue resulting from pyrolysis of a carbonaceous material to provide the particulate source of heat for pyrolysis of the carbonaceous material. This process maximizes the heating value obtained from oxidation of the carbon containing solid residue and minimizes pollution of the environment.

Carbonaceous materials pyrolyzed in accordance with the present invention include liquids such as shale oils, tar sand oils, heavy refinery hydrocarbons, heavy hydrocarbons which result from the pyrolysis operation, and the like, and solids such as tar sands, oil shales, the organic portion of solid waste, agglomerative and nonagglomerative coals, and the like, as well as mixtures thereof.

Figure 1:
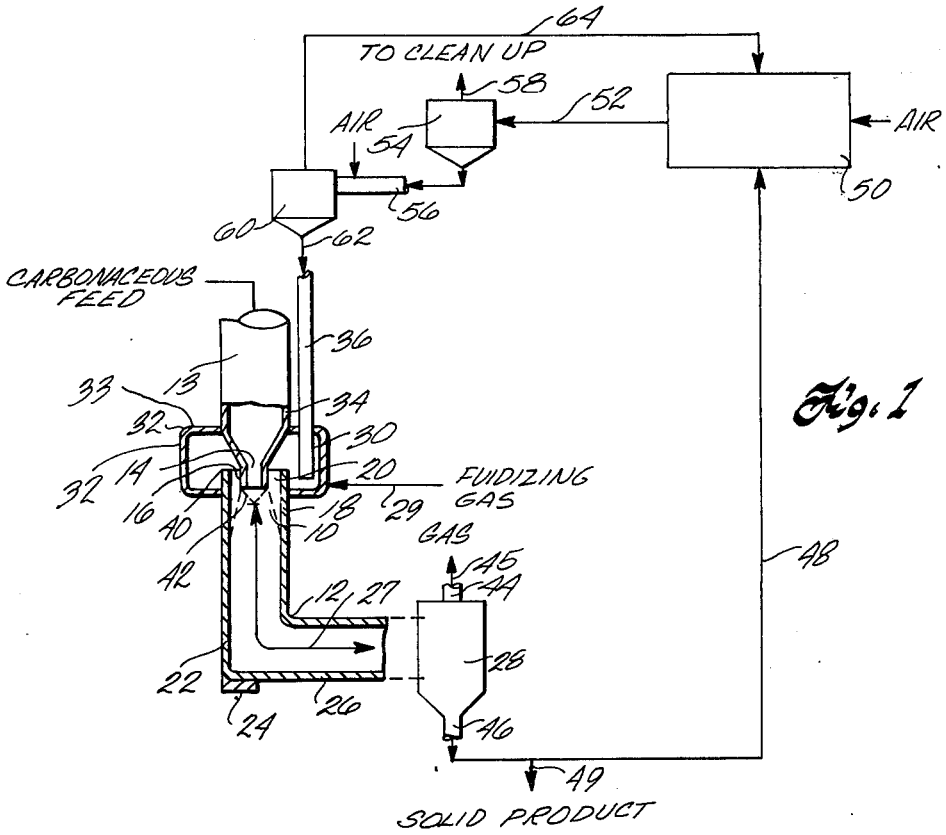
FIG. 1 illustrates a process embodying features of this invention.

Referring to FIG. 1, a carbonaceous material contained in a carrier gas which is nondeleteriously reactive with respect to pyrolysis products enters a mixing section 10 of a pyrolysis reactor 12 through a generally upright annular first conduit 13 terminating to form a first annular inlet into the mixing section and constricted at its end 16 to form a nozzle so that a fluid jet is formed thereby. The nozzle can be eliminated if the carbonaceous material is maintained at a sufficiently high velocity along the length of the conduit 13. The nozzle is water cooled to prevent caking of agglomerative coals, when pyrolyzed, in the nozzle.

As used herein, by a "nondeleteriously reactive" gas, there is meant a gas which is essentially free of free oxygen. Although constituents of the gas may react with pyrolysis products to upgrade their value, to be avoided are constituents which degrade pyrolysis products. The carrier gas may, for instance, be the off gas product of pyrolysis, steam which will react under suitable conditions with char or coke formed from pyrolysis to yield by water-gas reactions hydrogen which serves to react with and stabilize unsaturates in the products of pyrolysis, any desired inert gas, or mixtures thereof.

The carbonaceous material may be treated before it is fed to the pyrolysis reaction zone 12 by processes such as removal of inorganic fractions by magnetic separation and classification, particularly in the case of municipal solid waste. The carbonaceous material also can be dried to reduce its moisture content. A solid carbonaceous material usually is comminuted to increase the surface area available for the pyrolysis reaction.

The pyrolysis reactor 12 is annular and has an upper end 18, which is an open end of larger diameter than the nozzle 16, thereby surrounding the nozzle and leaving an annular gap 20 between the upper end 18 of the reactor and the nozzle 16. The reactor has an elbow 22 in the middle which rests upon a support 24. The lower end 26 of the reactor terminates in a reactor product stream separation zone such as cyclone 28. An annular fluidizing chamber 30 is formed by a tubular section 32 with an annular rim 33 connected to the first inlet wall 34 and the upper portion of the reactor. The chamber 30 surrounds the nozzle 16 and a portion of the upper end 18 of the reactor.

A second inlet 36, which is generally vertically connected to the annular fluidizing chamber 30, receives a particulate source of heat which is introduced into the fluidizing chamber simultaneously with the carbonaceous material. A fluidizing gas 29 which is nondeleteriously reactive with respect to pyrolysis products may be used as necessary to convey the particulate source of heat through the fluidizing chamber 30. The particulate source of heat serves to provide the heat required for the pyrolysis reaction and, in the case of agglomerative solid carbonaceous materials, it aids in preventing agglutination of the carbonaceous material.

Preferably, the second annular inlet 36 discharges the particulate source of heat below the top edge 40 of the reactor so that incoming source of heat particules build up in the fluidizing chamber 30 and are restrained by the weir formed by the upper end 18 of the reactor. The particulate source of heat in the chamber 30 passes over the upper end of the weir and through the opening 20 between the weir and the nozzle into the mixing section 10 of the reactor. Once inside the mixing section, the source of heat particles fall into the path of the fluid jet of the carbonaceous material feed coming from the nozzle and are entrained thereby as shown by broken line 42, yielding a resultant turbulent mixture containing carbonaceous material, particulate source of heat, and the carrier and fluidizing gases.

In the pyrolysis reaction zone 10, mixing and intimate contact of the particulate source of heat and carbonaceous material occur, with heat transfer from the particulate solid source of heat to the carbonaceous material. This causes pyrolysis which is a combination of vaporization and cracking reactions. A pyrolytic vapor containing condensible and noncondensible hydrocarbons is generated from the carbonaceous material with an attendant production of a carbon containing solid residue such as coke or char. The hot particulate solids are supplied at a rate and a temperature in the pyrolysis reaction zone 12 suitable for pyrolysis. Pyrolysis initiates at about 600° F and may be carried out up to a temperature above 2000° F. Preferably, however, pyrolysis is conducted at a temperature of from about 900° to about 1400° F to maximize the yield of condensible hydrocarbons. Higher temperatures by contrast enhance gasification reactions. The maximum temperature in the pyrolysis reactor is limited by the temperature at which the inorganic portion of the particulate source of heat of carbonaceous material softens with resultant fusion or slag formation.

Depending upon the pyrolysis temperature, normally from about 2 to about 20 pounds of particulate solid source of heat are fed per pound of carbonaceous material entering the pyrolysis reactor 10. At these ratios, the inlet temperature of the particulate source of heat is from about 100° to about 500° F or more above the desired pyrolysis temperature.

The amount of gas employed to transport the solid carbonaceous material and the particulate source of heat is sufficient to maintain transport of the solids and avoid plugging in the reactor. Normally the resultant turbulent mixture has a solids content ranging from about 0.1 to about 10% by volume based on the total volume of the stream.

In the pyrolysis of coal, char is the carbon containing solid residue, and can also serve as the particulate source of heat.

The effluent stream from the pyrolysis reactor contains a gas and a solids mixture of the carbon containing solid residue and particulate source of heat. The solids mixture is separated from the gas in the cyclone separator 28 and discharged through the top vent 44. The gas stream 45 contains pyrolytic vapors comprising volatilized hydrocarbons, carrier gases, and nonhydrocarbon components such as hydrogen and carbon monoxide which may be generated in the pyrolysis reaction. The volatilized hydrocarbons produced by pyrolysis consist of condensible hydrocarbons which may be recovered by simply contacting the volatilized hydrocarbons with condensation means, and noncondensible hydrocarbons such as methane and other hydrocarbon gases which are nonrecoverable by ordinary condensation means at ambient temperature and pressure. Condensible hydrocarbons can be separated and recovered by conventional means such as venturi scrubbers, indirect heat exchangers, wash towers, and the like. Undesirable gaseous products such as hydrogen sulfide or carbon dioxide can be removed from the uncondensible gas stream by means such as chemical scrubbing. Remaining uncondensed gases can be sold as a product gas stream and can be utilized as the carrier gas for carrying the carbonaceous material and the particulate source of heat to the pyrolysis reaction zone 12.

Excess solids produced in the pyrolysis reactor beyond what is required for oxidation to form the particulate source of heat represent the net solid product of the pyrolysis reaction and are withdrawn through line 49.

Although the tubular pyrolysis reactor 12 and the pyrolysis product cyclone 28 are shown in the drawings as two separate vessels, the carbonaceous material can be pyrolyzed in a cyclone pyrolysis reactor which simultaneously separates the pyrolysis vapors from the particulate source of heat and carbon containing solid residue.

The solids mixture separated in the cyclone 28 is passed from the bottom outlet 46 through line 48 to a heating zone 50. A lifting or fluidizing gas can be used if necessary to convey the solids mixture through line 48 to the heating zone 50.

In the heating zone, the solids mixture containing carbon containing solid residue is preheated with a hot gas. This heating preferably is effected by direct contact between the hot gas and the carbon containing solid residue to obtain maximum possible heat transfer to the carbon containing solid residue.

The preheated carbon containing solid residue is then separated from at least the bulk of the hot gas present in the heating zone in a first separation zone such as cyclone separator 54. Preferably, some downflow of gas is allowed to prevent fines from being vented out the top of the cyclone 54 and to convey the preheated carbon containing solid residue to a combustion zone 56.

If oxygen is present in the heating zone, the oxygen can react with carbon containing solid residue in the heating zone to form particulate source of heat, carbon monoxide, and carbon dioxide. In addition, carbon dioxide in the heating zone can react with carbon containing solid residue according to the reaction:

$$C + CO_2 \rightarrow 2CO$$

Therefore, it is preferred that the temperature in the heating zone 50 and first cyclone separator 54 be maintained at less than about 1800° F to minimize formation of carbon monoxide which, when vented from the separator, represents a loss of potential heat energy.

The gas stream 58 vented from the top of the cyclone separator 54 contains nonreactive components of the gases present in the heating zone and possibly carbon monoxide formed by the oxidation of the carbon containing solid residue in the heating zone 50 and cyclone separator 54. This stream can be sent to a clean-up operation (not shown) to recover entrained fines, and if it contains appreciable amounts of carbon monoxide, it can be combusted in a waste heat boiler to produce steam. The gas stream 58 can also be used as a carrier and fluidizing gas for carrying the solids mixture through line 48.

Next, a portion of preheated carbon containing solid residue separated in the first cyclone separator 54 is at least partially oxidized in the presence of a source of oxygen in the combustion zone to yield gaseous combustion products of the carbon containing solid residue such as carbon monoxide and carbon dioxide and to form the particulate source of heat. Apparatuses which provide intimate mixing between a gas and solid stream can be used for the combustion zone, such as the tubular reactor 56 shown in FIG. 1. The preferred source of oxygen is air, but also an air stream partially depleted of oxygen or a flue gas stream containing oxygen may be used as the source of oxygen.

The combustion zone is maintained at a temperature consonant with the temperature requirements of the pyrolysis reaction zone. Depending upon the weight ratio of the particulate source of heat to the carbonaceous material in the pyrolysis reaction zone, the combustion zone is maintained at a temperature from about 100 to about 500° F or more higher than the pyrolysis reaction zone. In any case, the combustion zone is at a higher temperature than the heating zone due to the exothermic oxidation of the carbon containing solid residue.

The amount of oxygen containing gas fed to the combustion zone is controlled to maintain the desired temperature in the combustion zone. This is always less than the stoichiometric amount required to completely oxidize all of the carbon containing solid residue. Due to this deficiency of oxygen and the high temperature in the combustion zone which can range from 1100° F in the case of a pyrolysis reaction zone maintained at about 600° F to over 2000° F for a pyrolysis reaction zone maintained at a temperature which enhances gasification reactions, appreciable amounts of carbon monoxide are formed in the combustion zone.

The particulate source of heat formed by the oxidation reaction in the combustion zone is separated from the gaseous combustion products of the carbon containing solid residue in a second separation zone such as second cyclone separator 60. The particulate source of heat is drawn from the bottom of the second cyclone 60 and passed via line 62 into the fluidizing chamber 30 of the pyrolysis reactor 12.

Inlet velocities of from about 60 feet per second to about 120 feet per second are maintained for the first 54 and second 60 cyclone separators. At velocities less than about 60 feet per second, efficient separation of solids from gas cannot be effected, and at velocities greater than about 120 feet per second significant abrasion of the cyclone inner wall and attrition of the char particles can result.

The flue gas stream 64 withdrawn from the top of the second cyclone 60 contains gaseous combustion products of the carbon containing solid residue such as carbon monoxide and nonreactive components of the source of oxygen such as nitrogen and also fines of the carbon containing solid residue. This gas stream 64 is combined with a sufficient amount of oxygen in an oxygen containing gas such as air in the heating zone 50 thereby substantially completely oxidizing carbon monoxide in the flue gas to carbon dioxide to form the hot gas for preheating the carbon containing solid residue.

Figure 2:
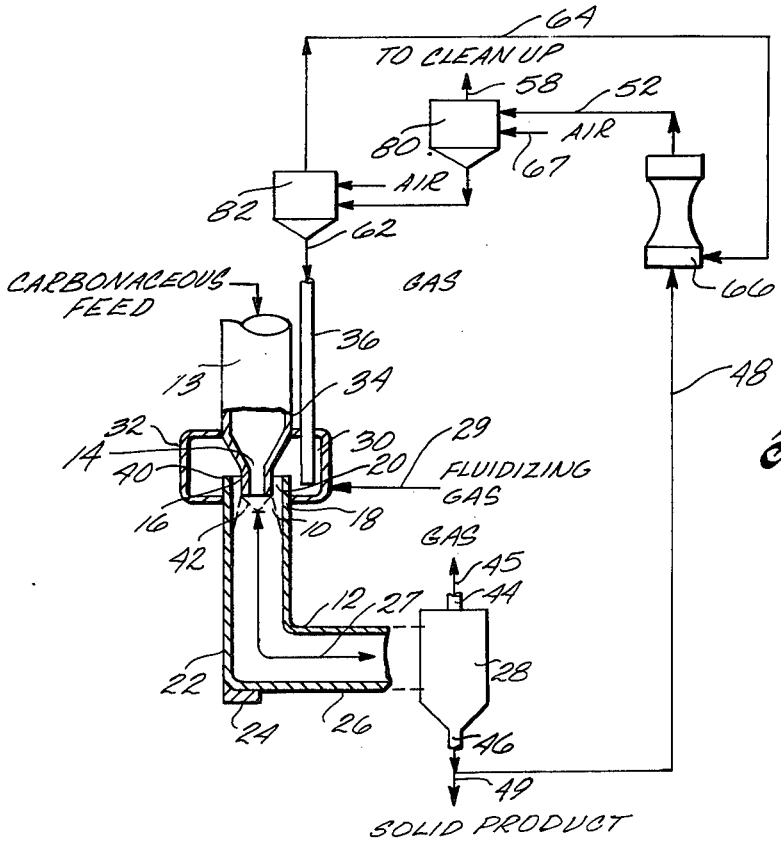
FIG. 2 shows a version of the process of FIG. 1.

The amount of oxygen introduced into the heating zone is preferably at least the stoichiometric amount required to completely oxidize the carbon monoxide in the flue gas so the total potential heating value of the carbon containing solid residue oxidized in the combustion zone is obtained. However, if too much oxygen is fed to the heating zone, a portion of this oxygen combines with carbon containing solid residue. This is undesirable because some formation of carbon monoxide is inevitable in the heating zone, even though it is operated at low temperature to favor production of carbon dioxide. Thus, the amount of oxygen introduced to the heating zone is as close as possible to stoichiometric, but preferably a slight excess is maintained to ensure complete oxidation of the carbon monoxide produced in the combustion zone. Although FIG. 1 shows the flue gas 64, carbon containing solid residue 48, and source of oxygen all being combined simultaneously in the heating zone 50, these steams may be sequentially combined. For example, the flue gas 64 can be combined with oxygen to form a hot gas stream, and the hot gas stream then can be combined with carbon containing solid residue. Alternately, the source of oxygen can be combined with the carbon containing solid residue and then this combined stream can then be combined with the flue gas. A third way to combine the three steams, as shown in FIG. 2, is to mix the carbon containing solid residue with the flue gas 64 and then add in the source of oxygen. This third way is preferred because it has the advantage that the carbon containing solid residue is not exposed to the high temperatures resulting from oxidation of the carbon monoxide in the combustion gases because the carbon containing solid residue is heated simultaneously with the generation of the reaction heat of the carbon monoxide and oxygen. Thus, there is less opportunity for carbon monoxide formation to occur because the amount of carbon monoxide formation from the reaction of carbon containing solid residue and carbon dioxide is increased at high temperatures.

FIG. 2 represents a version of this invention which differs from the version shown in FIG. 1 in three ways. First, the carbon containing solid residue is preheated in two steps. In the first step the carbon containing solid residue 48 is combined with the flue gas 64 in an ejector-mixer 66. The ejector-mixer serves to raise the pressure of the flue gas stream 64 from the second cyclone up to the inlet pressure of the first cyclone. In the second step the flue gas and carbon containing solid residue are combined with a source of oxygen such as air 67. The exothermic oxidation of carbon monoxide in the flue gas stream 64 releases heat which further heats the carbon containing solid residue.

The advantage of combining the carbon containing solid residue with flue gas 64 and then adding the source of oxygen is reduced carbon monoxide formation as described above.

A second difference between the versions of this invention shown in FIGS. 1 and 2 is that in FIG. 2 the preheated carbon containing solid residue is further preheated and separated from the hot gas simultaneously in a single cyclone heating-separation zone 80. And the third difference is that the preheated carbon containing solid residue is oxidized and the particulate source of heat is separated from the gaseous combustion products of the carbon containing solid residue simultaneously in a cyclone combustion-separation zone 82. Any one, two, or three of these changes may be made in the process of FIG. 1.

These second and third changes also result in significant advantages. Among these advantages is reduced carbon monoxide formation because short reaction times are obtainable by using cyclone vessels for oxidizing the carbon containing solid residue. It is preferred that the residence times of solids in both the cyclone heating-separation zone 80 and the cyclone combustion-separation zone 82 be less than about 5 seconds, and more preferably from about 0.1 to about 3 seconds. These short residence times favor production of carbon dioxide compared to carbon monoxide. Another advantage is that carbon containing solid residue fines, which are less valuable than larger particles, are burned preferentially because of the fast separation of larger particles in a cyclone.

In general it is preferred that the size of the heating 50 and combustion 56 zones be minimized to minimize the residence of the process streams in these zones, and thus minimize carbon monoxide production. Elimination of these two zones as separate zones in the version of the invention shown in FIG. 2 is the ultimate result of this concept.

The processes shown in FIGS. 1 and 2 have many advantages, including maximization of energy recovered from the oxidation of the carbon containing solid residue by converting substantially all of the carbon monoxide formed during the oxidation to carbon dioxide and transferring a large portion of the heat so obtained to the incoming carbon containing solid residue. Also, the quantity of fines vented from the first cyclone 54 is significantly reduced by diverting a portion of the hot gas flow to the second cyclone 60 via the solids discharge.

Although this invention is described in terms of certain preferred versions thereof, other versions of this invention are obvious to those skilled in the art. For example, the ejector used to raise the pressure of the flue gas from the second cyclone can be eliminated. Sufficient static head can be raised with a standpipe between the first and second cyclone to raise the gas outlet pressure from the second cyclone above the inlet pressure to the first cyclone. Because of variations such as this, the spirit and scope of the appended claims should not necessarily be limited to the description of the versions of the invention described below.

What is claimed is:

1. In a continuous process for pyrolyzing a carbonaceous material in which heat for pyrolysis is obtained by partially oxidizing a carbon containing solid residue of said pyrolysis in the presence of oxygen in a combustion zone to form a particulate source of heat which is combined with the carbonaceous material in a pyrolysis reaction zone to initiate pyrolysis of the carbonaceous material, the improvement comprising the steps of:

a. at least partially oxidizing in the combustion zone a portion of a preheated carbon containing solid residue in the presence of oxygen to yield the particulate source of heat and gaseous combustion products including carbon monoxide;
b. separating the particulate source of heat from the gaseous combustion products of the preheated carbon containing solid residue in a first cyclone separation zone;
c. passing the particulate source of heat to the pyrolysis reaction zone to provide at least a portion of the heat required for pyrolysis of the carbonaceous material to produce the carbon containing solid residue;
d. preheating said carbon containing solid residue by combining in direct contact, in a heating zone maintained at a temperature less than the temperature in the combustion zone, the carbon containing solid residue, at least a portion of the carbon monoxide containing gaseous combustion products formed by combustion of the preheated carbon containing solid residue and a source of oxygen in an amount sufficient to completely oxidize the carbon monoxide in the gaseous combustion products; and
e. separating in a second cyclone separation zone the preheated carbon containing solid residue from at least the bulk of the gases present in the heating zone for feed to the combustion zone.

2. A process as claimed in claim 1 in which the step of preheating comprises directly contacting carbon containing solid residue with at least a portion of the gaseous combustion products of the carbon containing solid residue and then directly contacting the combined stream of the carbon containing solid and gaseous combustion products with the source of oxygen.

3. The process of claim 2 in which the carbon containing solid residue is maintained at a temperature less than about 1800° F.

4. A process as claimed in claim 1 in which the step of preheating the carbon containing solid residue and the step of separating preheated carbon containing solid residue from the gases present in the heating zone occur simultaneously in a cyclone heating-separation zone.

5. The process of claim 4 in which the residence time of solids in the cyclone heating-separation zone is less than about 5 seconds.

6. The process of claim 4 in which a combined stream containing a portion of the gases present in the heating-separation zone and the preheated carbon containing solid residue is withdrawn from the cyclone heating-separation zone.

7. The process of claim 4 in which the residence time of solids in the cyclone heating-separation zone is less than about 3 seconds.

8. A process as claimed in claim 1 in which the step of partially oxidizing the preheated carbon containing solid residue and the step of separating particulate source of heat from gaseous combustion products occur simultaneously in a cyclone combustion-separation zone.

9. The process of claim 8 in which the residence time of solids in the cyclone combustion-separation zone is less than about 5 seconds.

10. The process of claim 8 in which the residence time of solids in the cyclone combustion-separation zone is less than about 3 seconds.

11. The process of claim 1 in which a combined stream containing preheated carbon containing solid residue and a portion of the gases present in the heating zone is withdrawn from the second cyclone separation zone.

12. A process as claimed in claim 1 in which the step of combining gaseous combustion products of the carbon containing solids residue with a source of oxygen comprises combining gaseous combustion products of the carbon containing solid residue with greater than a stoichiometric amount of an oxygen to completely oxidize the carbon monoxide in the gaseous combustion products so that at least a portion of the carbon containing solid residue in the heating zone is partially oxidized with the excess oxygen.

13. The process of claim 1 in which the heating zone is maintained at a temperature less than about 1800° F.

14. A process as claimed in claim 1 in which the step of preheating comprises combining a source of oxygen with carbon containing solid residue and then combining the combined stream of the carbon containing solid residue and source of oxygen with the gaseous combustion products.

15. A process as claimed in claim 1 in which the carbonaceous material is coal.

16. A process as claimed in claim 1 in which the carbonaceous material is the organic portion of solid waste.

17. In a continuous process for pyrolyzing a carbonaceous material in which heat for pyrolysis is obtained by partially oxidizing a carbon containing solid residue of pyrolysis in the presence of oxygen to form a particulate source of heat which is combined with the carbonaceous material in a pyrolysis reaction zone to initiate pyrolysis of the carbonaceous material, the improvement comprising the steps of:

a. at least partially oxidizing in a cyclone combustion-separation zone a portion of a preheated carbon containing solid residue in the presence of oxygen to yield gaseous combustion products including carbon monoxide and form the particulate source of heat while simultaneously separating the particulate source of heat from the gaseous combustion products in the combustion-separation zone
b. passing the particulate source of heat to the pyrolysis reaction zone to provide at least a portion of the heat required for pyrolysis of the carbonaceous material to produce the carbon containing solid residue;
c. preheating the carbon containing solid residue of pyrolysis, in a heating stage, by directly contacting the carbon containing solid residue of pyrolysis with at least a portion of the gaseous combustion products formed in the combustion-separation zone from combustion of the preheated carbon containing solid residue; and
d. further heating the preheated carbon containing solid residue of pyrolysis from the heating stage by combining, in a cyclone heating-separation zone maintained at a temperature less than the temperature of the combustion-separation zone, the preheated carbon containing solid residue of pyrolysis and gases from the heating stage with a sufficient amount of oxygen to completely oxidize the carbon monoxide in the gases present in said heating stage while simultaneously separating the further heated carbon containing solid residue of pyrolysis from gases present in the cyclone heating-separation zone for feed to the cyclone combustion-separation zone.

18. The process of claim 17 in which the residence time of solids in the cyclone heating-separation zone is less than about 5 seconds.

19. The process of claim 17 in which the residence time of solids in the cyclone combustion-separation zone is less than about 5 seconds.

20. The process of claim 17 in which the residence time of solids in the cyclone combustion-separation zone is less than about 3 seconds.

21. The process of claim 17 in which the temperature in the cyclone heating-separation zone is less than about 1800° F.

22. A process as claimed in claim 17 in which the carbonaceous material is coal.

23. A process as claimed in claim 17 in which the carbonaceous material is the organic portion of solid waste.

24. A continuous process for pyrolyzing carbonaceous material comprising the steps of:

a. directly contacting carbonaceous material with a particulate source of heat comprising carbon containing solid residue in a pyrolysis reaction zone maintained at a temperature greater than about 600° F to yield as products of pyrolysis a pyrolytic vapor and carbon containing solid residue b. separating carbon containing solid residue from the pyrolytic vapor;

c. preheating in a heating zone the separated carbon containing solid residue by:

i. combining the separated carbon containing solid residue with carbon monoxide containing gaseous combustion products of carbon containing solid residue; and ii. substantially completely oxidizing the carbon monoxide contained in the gaseous combustion products in the presence at least a stoichiometric amount of oxygen;

d. separating from at least the bulk of the gases present in the heating zone carbon containing solid residue for feed to a combustion zone;

e. at least partially oxidizing in the combination zone, a portion of the preheated carbon containing solid residue in the presence of oxygen to yield carbon monoxide containing gaseous combustion products of carbon containing solid residue and form a particulate source of heat;

f. separating the particulate source of heat from the carbon monoxide containing gaseous combustion products; and g. recycling at least a portion of the formed particulate source of heat to the pyrolysis zone.

25. A process as claimed in claim 24 in which the carbonaceous material is coal.

26. A process as claimed in claim 24 in which the carbonaceous material is the organic portion of solid waste.

* * * * *

UNITED STATES PATENT AND TRADEMARK OFFICE

CERTIFICATE OF CORRECTION

PATENT NO. : 4,071,432

DATED : January 31, 1978

INVENTOR(S) : Everett W. Knell et al

It is certified that error appears in the above-identified patent and that said Letters Patent are hereby corrected as shown below:

Column 2, line 59, for "for" read -- to --.
Column 4, line 25, for "particules" read -- particles --.
Column 7, line 37, for "steams" read -- streams --; line 44, for "steams" read -- streams --.
Column 11, line 32, after "residue" insert -- ; --.

Signed and Sealed this

Fourth Day of July 1978

[SEAL]

*Attest:*

RUTH C. MASON
*Attesting Officer*

DONALD W. BANNER
*Commissioner of Patents and Trademarks*